US010436050B2

(12) United States Patent
Filipenco et al.

(10) Patent No.: US 10,436,050 B2
(45) Date of Patent: Oct. 8, 2019

(54) GUIDE VANE ARRANGEMENT FOR GAS TURBINE ENGINE

(71) Applicant: United Technologies Corporation, Farmington, CT (US)

(72) Inventors: Victor G. Filipenco, Portland, CT (US); Michael C. Firnhaber, East Hampton, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 253 days.

(21) Appl. No.: 15/484,190

(22) Filed: Apr. 11, 2017

(65) Prior Publication Data

US 2018/0291753 A1 Oct. 11, 2018

(51) Int. Cl.

| | |
|---|---|
| ***F01D 25/16*** | (2006.01) |
| ***F01D 9/06*** | (2006.01) |
| ***F01D 5/02*** | (2006.01) |
| ***F01D 9/04*** | (2006.01) |
| ***F01D 25/18*** | (2006.01) |
| ***F01D 11/00*** | (2006.01) |
| ***F01D 17/16*** | (2006.01) |

(52) U.S. Cl.

CPC ..... *F01D 9/065* (2013.01); *F01D 5/02* (2013.01); *F01D 9/041* (2013.01); *F01D 11/001* (2013.01); *F01D 17/162* (2013.01); *F01D 25/162* (2013.01); *F01D 25/18* (2013.01); *F05D 2220/32* (2013.01); *F05D 2230/60* (2013.01)

(58) Field of Classification Search

CPC ..... F01D 9/065; F01D 9/041; F01D 17/162; F01D 11/001; F01D 25/162; F01D 5/02; F05D 2230/50; F05D 2220/32

USPC ..... 415/112

See application file for complete search history.

(56) References Cited

U.S. PATENT DOCUMENTS 2,941,781 A * 6/1960 Boyum ..... F01D 25/162 415/142
4,135,362 A 1/1979 Glenn
8,894,361 B2 11/2014 Rodriguez et al.
(Continued)

FOREIGN PATENT DOCUMENTS

EP 1843008 10/2007
EP 2503101 9/2012
(Continued)

OTHER PUBLICATIONS

Partial European Search Report for European Patent Application No. 18166411 dated Sep. 11, 2018.

*Primary Examiner* — Hai H Huynh
(74) *Attorney, Agent, or Firm* — Carlson, Gaskey & Olds, P.C.

(57) ABSTRACT

An inlet section for a gas turbine engine according to an example of the present disclosure includes, among other things, an outer case extending about a rotor that is rotatable about an engine axis. The rotor carries a plurality of airfoils. A plurality of guide vanes are operable to guide flow from an engine inlet toward the plurality of airfoils relative to the engine axis. A plurality of spokes are mechanically attached to the outer case. Each of the plurality of spokes is received in a respective one of the plurality of guide vanes, and at least one of the plurality of spokes define a fluid passage in flow communication with a bearing assembly.

23 Claims, 4 Drawing Sheets

(56) References Cited

U.S. PATENT DOCUMENTS

| | | | |
|---|---|---|---|
| 2015/0345322 | A1 | 12/2015 | Cheng et al. |
| 2016/0237844 | A1 | 8/2016 | Holowczak |

FOREIGN PATENT DOCUMENTS

| | | |
|---|---|---|
| WO | 2015026597 | 2/2015 |
| WO | 2015050730 | 4/2015 |

* cited by examiner

GUIDE VANE ARRANGEMENT FOR GAS TURBINE ENGINE

BACKGROUND

This disclosure relates to guiding flow through a gas turbine engine, and more particularly to a guide vane arrangement.

A gas turbine jet engine typically includes a compressor section, a combustor section, and a turbine section, and may also include a fan section. Air entering the fan section (if present) and then the compressor section is compressed and delivered into the combustion section where it is mixed with fuel and ignited to generate a high temperature high pressure gas which upon expansion through the turbine section produces the shaft power required to drive the compressor and the fan sections. Some gas turbine engines incorporate struts in an inlet case which are used to provide radial support to bearings which allow rotation of one or more shafts of the engine.

SUMMARY

An inlet section for a gas turbine engine according to an example of the present disclosure includes an outer case extending about a rotor that is rotatable about an engine axis. The rotor carries a plurality of airfoils. A plurality of guide vanes are operable to guide flow from an engine inlet toward the plurality of airfoils relative to the engine axis. A plurality of spokes are mechanically attached to the outer case. Each of the plurality of spokes is received in a respective one of the plurality of guide vanes, and at least one of the plurality of spokes define a fluid passage in flow communication with a bearing assembly.

In a further embodiment of any of the foregoing embodiments, the section is free of any bifurcations and rotatable airfoils between the engine inlet and the plurality of guide vanes.

In a further embodiment of any of the foregoing embodiments, the bearing assembly supports a forward portion of the rotor relative to the engine axis.

In a further embodiment of any of the foregoing embodiments, each of the plurality of guide vanes is rotatable about a respective one of the plurality of spokes to vary flow to the plurality of airfoils.

In a further embodiment of any of the foregoing embodiments, the fluid passage is operable to communicate lubricant between the bearing assembly and a lubrication source.

The inlet section as recited in claim 1, comprising a shroud mechanically attached to the plurality of spokes, the shroud supporting the bearing assembly.

In a further embodiment of any of the foregoing embodiments, the shroud includes a first annular hoop and a second annular hoop joined together to support radially inward ends of the plurality of spokes.

In a further embodiment of any of the foregoing embodiments, the plurality of spokes are operable to transfer loads between the rotor and the outer case.

A further embodiment of any of the foregoing embodiments include a bearing carrier trapped between the shroud and the rotor within a bearing compartment defined by the bearing assembly.

A gas turbine engine according to an example of the present disclosure includes a section that has an engine inlet and an outer case. The outer case at least partially surrounds a rotor that is rotatable about an engine axis, the rotor carrying a plurality of airfoils, and a bearing assembly supporting a forward portion of the rotor. The bearing assembly defines a bearing compartment. A turbine drives a fan or a compressor. A guide vane assembly includes a plurality of guide vanes operable to guide flow from the engine inlet toward a forwardmost row of the plurality of airfoils, and a plurality of spokes mechanically attached to the outer case. Each of the plurality of spokes is received in a respective one of the plurality of guide vanes, and at least some of the plurality of spokes define a fluid passage in flow communication with the bearing compartment.

In a further embodiment of any of the foregoing embodiments, the section is dimensioned such that substantially all incoming flow through the engine inlet is delivered to the guide vane assembly.

In a further embodiment of any of the foregoing embodiments, the section is attached to a nacelle assembly operable to guide flow to the engine inlet and around the engine.

In a further embodiment of any of the foregoing embodiments, the section is free of any bifurcations and rotatable airfoils forward of the guide vane assembly.

The gas turbine engine as recited in claim 13, comprising a nose cone configured to guide flow between the engine inlet and the guide vane assembly.

In a further embodiment of any of the foregoing embodiments, the plurality of spokes are operable to transfer loads between the bearing assembly and the outer case.

In a further embodiment of any of the foregoing embodiments, each of the plurality of guide vanes is rotatable about a respective one of the plurality of spokes to vary flow to the plurality of airfoils.

A further embodiment of any of the foregoing embodiments include a hub including a first annular hoop and a second annular hoop joined together to support radially inward ends of the plurality of spokes, with the shroud defining the bearing compartment.

A method of assembly for a section of a gas turbine engine according to an example of the present disclosure includes providing a hub that has a first annular hoop and a second annular hoop, moving the first annular hoop along an axis to at least partially surround a rotor carrying a plurality of airfoils, with an end of the rotor supported by a bearing assembly, and attaching a plurality of spokes to an outer case that at least partially surrounds the plurality of airfoils. Each of the plurality of spokes support a guide vane operable to guide flow from an engine inlet toward the plurality of airfoils. The method includes moving the second annular hoop along the axis to abut the first annular hoop and support radially inward ends of the plurality of spokes, with the hub supporting the bearing assembly.

A further embodiment of any of the foregoing embodiments include tensioning each of the plurality of spokes, with the plurality of spokes operable to transfer loads between the end of the rotor and the outer case.

In a further embodiment of any of the foregoing embodiments, one or more of the plurality of spokes defines a fluid passage operable to communicate lubricant between a bearing compartment of the bearing assembly and a lubrication source.

Although the different examples have the specific components shown in the illustrations, embodiments of this disclosure are not limited to those particular combinations. It is possible to use some of the components or features from one of the examples in combination with features or components from another one of the examples.

The various features and advantages of this invention will become apparent to those skilled in the art from the following detailed description of an embodiment. The drawings that accompany the detailed description can be briefly described as follows.

DETAILED DESCRIPTION

Figure 1:
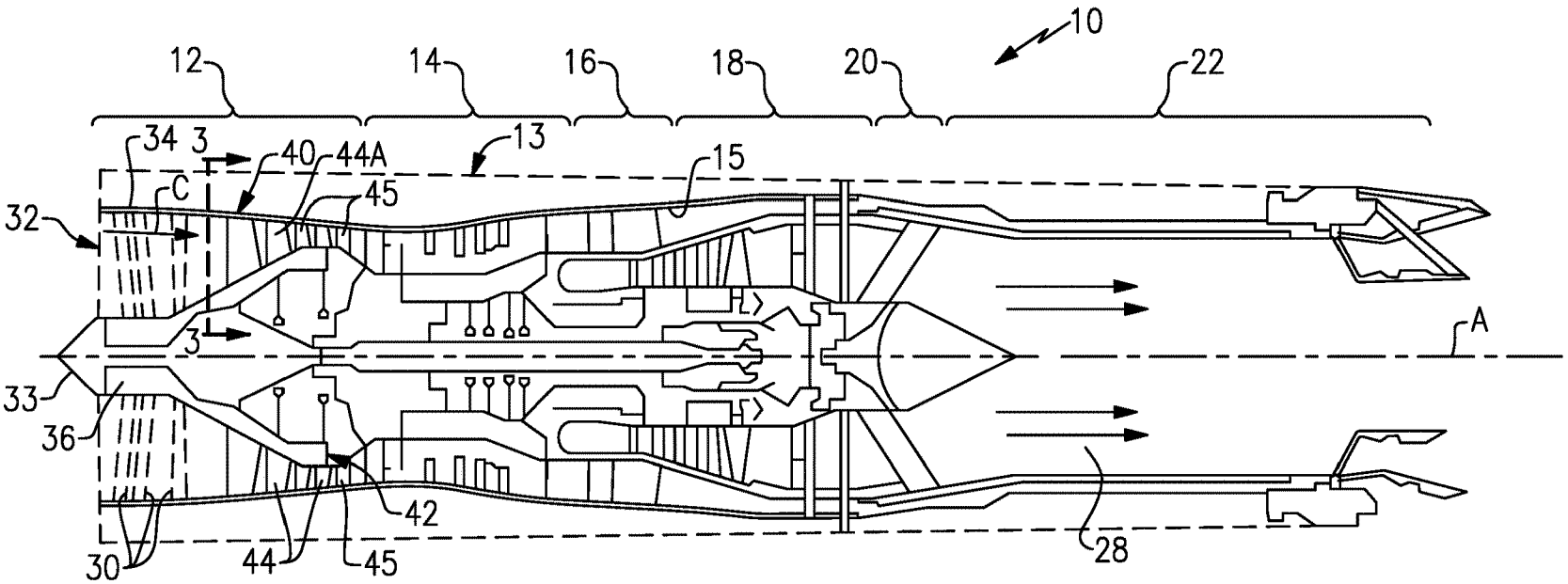
FIG. 1 schematically illustrates an example gas turbine engine.

Referring to FIG. 1, a schematic view of a gas turbine engine 10 includes a fan section 12, a compressor section 14, a combustor section 16, and a turbine section 18. The engine 10 is a low-bypass fanjet engine that can be utilized for high thrust military aircraft, for example. Air entering into the fan (or inlet) section 12 is initially compressed and fed to the compressor section 14. In the compressor section 14, a portion of the incoming air from the fan section 12 is further compressed and communicated to the combustor section 16. In the combustor section 16, the compressed air is mixed with gas and ignited to generate a hot exhaust stream 28.

The hot exhaust stream 28 is expanded through the turbine section 18 to drive the fan section 12 and the compressor section 14. In this example, the gas turbine engine 10 includes an augmenter section 20 where additional fuel can be mixed with fresh air directly from the fan section 12, which bypasses sections 14, 16 & 18, and ignited to generate additional thrust. Gasses of the exhaust stream 28 from the turbine section 18 and the air burned in the augmenter section 20 flow through an exhaust liner assembly 22. Although FIG. 1 depicts engine 10 as a bypass engine having a low spool and a high spool, it should be understood that the concepts and teachings described herein may be applied to other types of engines and systems including high bypass engines, non-bypass engines (i.e., with the first rotor stage being provided by a compressor), single-spool or three-spool architectures, and commercial and industrial gas turbine engines.

The fan section 12 includes an engine inlet 32 and a fan (or outer) case 34. The fan section 12 can be attached to a nacelle assembly 13 (shown in dashed lines) for guiding incoming airflow to the engine inlet 32 and around the engine 10. The fan case 34 extends about, and at least partially surrounds, a rotor assembly 42 that is rotatable about an engine axis A. The rotor assembly 42 carries a plurality of rotatable blades or airfoils 44 that can be arranged in one or more blade rows interspersed with one or more rows of static vanes 45. The fan section 12 can be dimensioned such that substantially all incoming flow through the engine inlet 32 is delivered to a guide vane assembly 40. In a further example, radially inner surfaces of the fan case 34 bound or otherwise define core flow path C. The engine 10 includes a bypass passage 15 configured to bypass a portion of flow around portions of the compressor section 14, combustor section 16 and/or turbine section 18, for example. In alternative examples, the engine 10 is a non-bypass engine in which the bypass passage 15 is omitted, with guide vane assembly 40 and rotor assembly 42 situated in the compressor section 14, with case 34 being a compressor case receiving substantially all incoming flow from the engine inlet 32, and with rotor assembly 42 being the forwardmost rotor stage of the engine 10 relative to the engine axis A.

In the illustrated example, the fan section 12 is free of any bifurcations between the engine inlet 32 and the guide vane assembly 40, or otherwise forward of the guide vane assembly 40. For the purposes of this disclosure the term "bifurcation" means a structure that substantially divides flow through one or more flow paths. Example bifurcations can include radially extending struts, rotatable airfoils and static vanes.

In alternative examples, the fan section 12 includes one or more radial extending bifurcations 30 (shown in dashed line). The bifurcations 30 can extend between fan case 34 and hub or shroud 36 situated downstream of a spinner or nose cone 38. The bifurcations 30 can provide structural support to forward portions of the engine 10 radially inward of the fan case 34.

Figure 2:
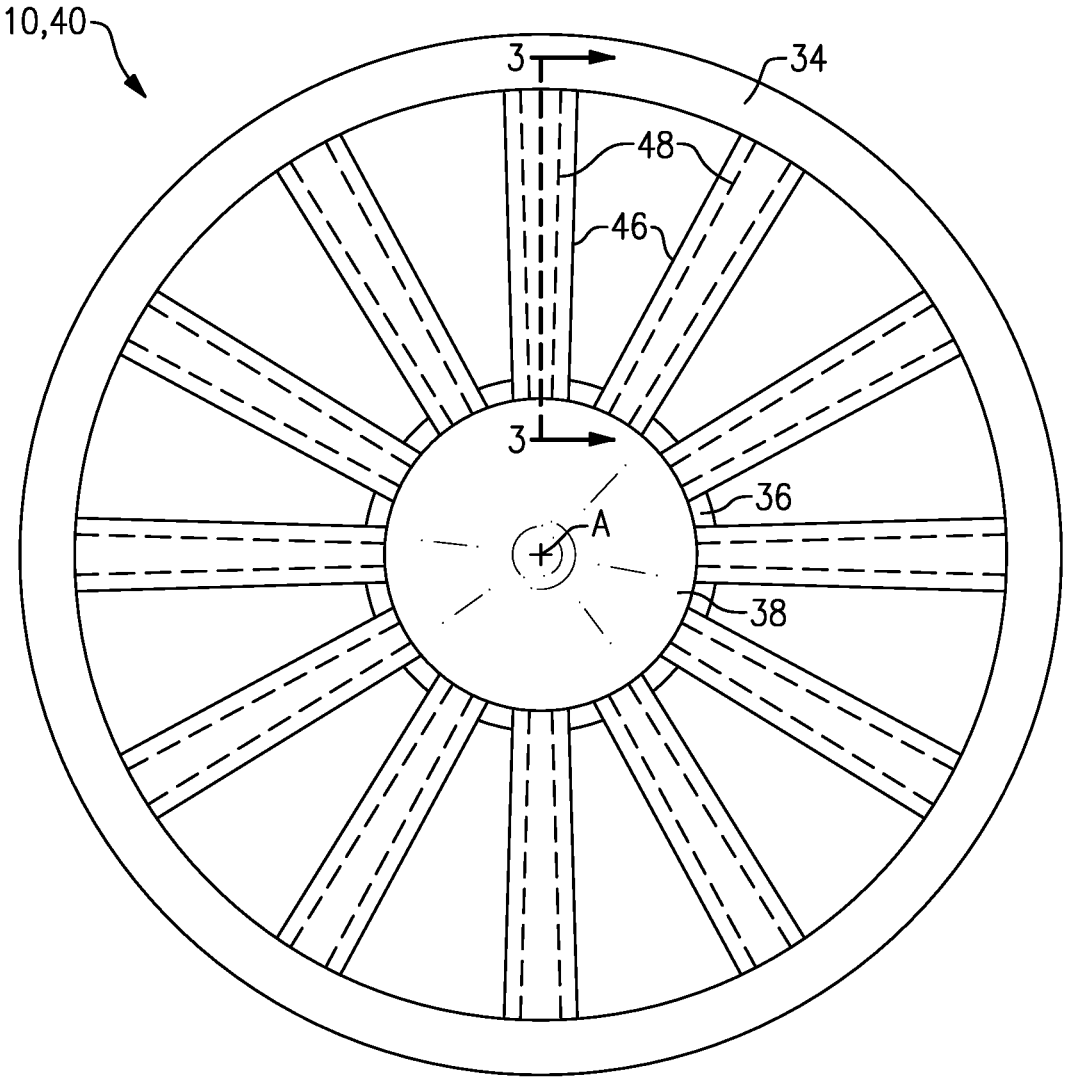
FIG. 2 illustrates a forward axial view of the gas turbine engine of FIG. 1.
Figure 4:
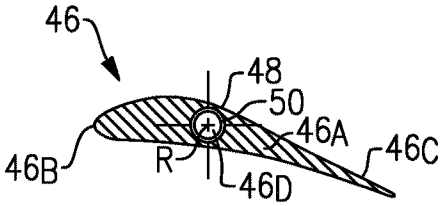
FIG. 4 illustrates a cross-sectional view of a guide vane taken along line 4-4 of FIG. 3.
Figure 3:
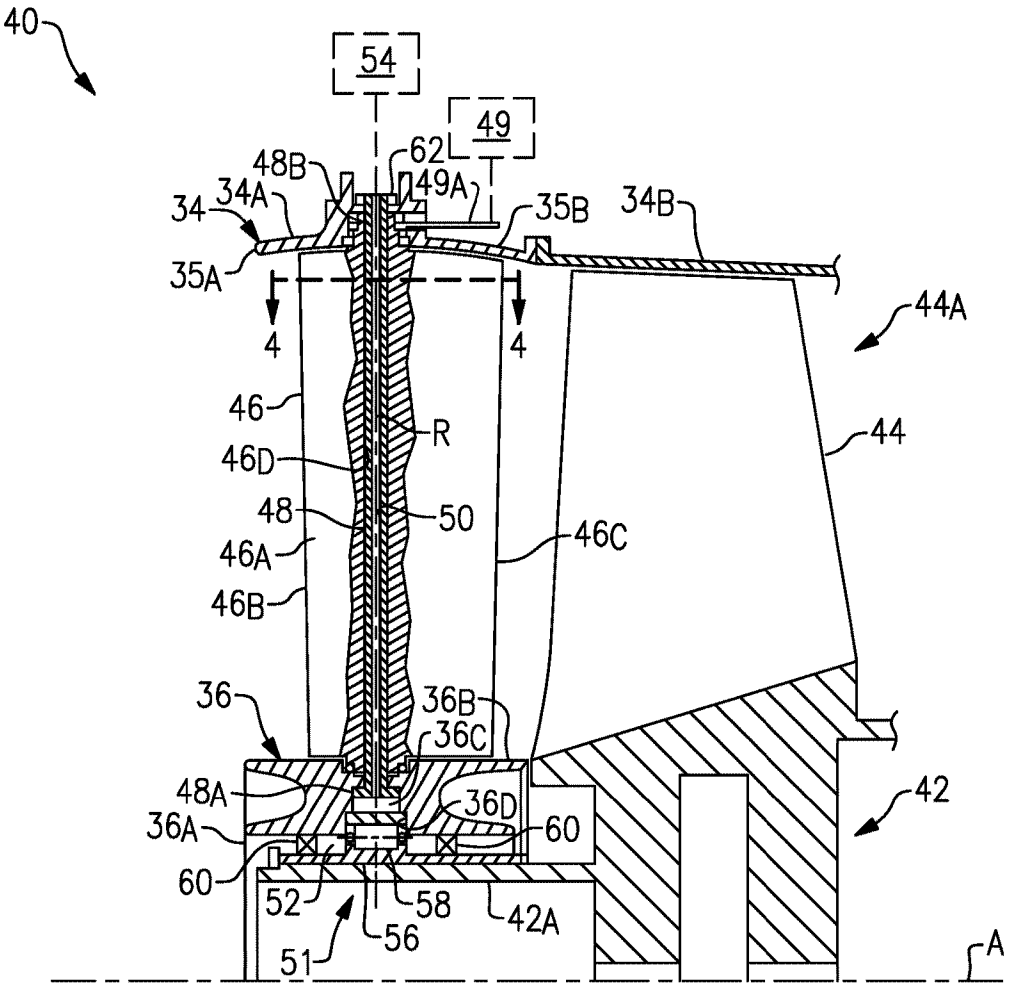
FIG. 3 illustrates a cross-sectional view of a guide vane assembly of the type described in this invention, taken along line 3-3 of FIG. 1.

Referring to FIGS. 2 to 4, the guide vane assembly 40 includes a plurality of guide vanes 46. Each guide vane 46 includes an airfoil body 46A extending in a chordwise direction between a leading edge 46B and a trailing edge 46C. Each guide vane 46 is contoured to guide flow through the core flow path C. The guide vanes 46 are distributed circumferentially about the shroud 36 and extend in a radial direction between the shroud 36 and the fan case 34.

In the illustrated example, the guide vane assembly 40 is an inlet guide vane (IGV) assembly, with guide vanes 46 being inlet guide vanes operable to control swirl distribution or otherwise guide flow from the engine inlet 32 toward a forwardmost stage or row 44A of airfoils 44 relative to the engine axis A. The nose cone 38 is configured to guide flow between the engine inlet 32 and the guide vane assembly 40, and can be attached to the shroud 36. Although the guide vane assembly 40 is primarily discussed relative to an IGV assembly, the guide vane assembly 40 can also be utilized at other stages in the fan or compressor sections 12, 14, and in other portions of the engine 10.

In some examples, the fan case 34 includes a first section 34A mechanically attached to a second section 34B. The first section 34A at least partially surrounds the guide vanes 46. The second section 34B at least partially surrounds the forwardmost row 44A of airfoils 44.

The guide vane assembly 40 includes a plurality of elongated spokes 48 operable to define a load path that transfer loads between the rotor assembly 42 and the fan case 34 via a bearing assembly 51. In the illustrated example, the bearing assembly 51 is a front bearing assembly supporting a low spool of the engine 10, and defines a bearing compartment 52.

Each of the spokes 48 is received in a bore 46D defined by a respective one of the guide vanes 46. The shroud 36 is mechanically attached to radially inward ends 48A of the spokes 48, with radially outward ends 48B of the spokes 48 mechanically attached to the fan case 34. The spokes 48 support the guide vanes 46 between the fan case 34 and the shroud 36. In some examples, the guide vane assembly 40 includes about twenty guide vanes 46 and spokes 48. In one example, fewer than each of the guide vanes 46 is provided with a spoke 48.

Each of the radially outward ends 48B of the spokes 48 can be attached to the fan case 34 via a fastener 62, such as a nut. The fastener 62 can be utilized to apply tension to the respective spoke 48. In alternative examples, the radially outward ends 48B of the spokes 48 can be threaded into the fan case 34.

Each of the guide vanes 46 is rotatable about an axis R defined by a corresponding one of the spokes 48 to vary flow to the airfoils 44 during various operating conditions of the engine 10, such as takeoff and cruise. Each guide vane 46 can be pivoted by an actuator 49 via at least one arm or linkage 49A. The actuator 49 can be a mechanical, fluid or hydraulically operated actuation device, for example. In one example, the actuator 49 is a synchronization ring rotatable about engine axis A to cause the guide vanes 46 to rotate according to a desired schedule. In another example, the actuator 49 is directly attached to radially outward ends 48B of the spokes 48 to cause each guide vane 46 to rotate about the respective axis R. In alternative examples, the guide vanes 46 are substantially fixed such that rotation about each axis R is minimized or reduced.

The shroud 36 defines a portion of the bearing compartment 52. In the illustrated example, the shroud 36 has a split arrangement that includes a first annular hoop 36A and a second annular hoop 36B joined together to support the radially inward ends 48A of the spokes 48. Each radially inward end 48A can define an annular flange to abut against walls of an adjacent recess 36C defined by the shroud 36. Each recess 36C can be contoured as a pocket that substantially conforms to a perimeter of the radially inner end 48A of a respective one of the spokes 48. In one example, the first section 34A of the fan case 34 includes forward and aft portions 35A, 35B that can be arranged and joined together in a similar manner as the radial split arrangement of the shroud 36.

The bearing assembly 51 includes a bearing carrier 56 configured to carry at least one bearing 58 situated in the bearing compartment 52. The bearing 58 is a roller bearing captured in a bearing race 36D defined by the first and second annular hoops 36A, 36B of shroud 36. In other examples, the bearing 58 is a thrust bearing, a set of tandem bearings sitting side by side relative to the engine axis A, ball bearings, or another type of bearing arrangement to support the rotor assembly 42. The bearing carrier 56 is trapped between the shroud 36 and the rotor assembly 42 within the bearing compartment 52 such that the bearing assembly 51 substantially supports the forward portion 42A of rotor assembly 42. The bearing assembly 51 can include one or more seals 60 to provide a sealing relationship between surfaces of the rotor assembly 42 and the shroud 36.

The bearing assembly 51 is situated forward of the axially forwardmost row 44A of airfoils 44. The spokes 48 cause the bearing 58 to be situated at a radially location that is substantially concentric with the fan case 34 relative to the engine axis A, which can improve uniformity of tip clearances between the fan case 34 and the airfoils 44 and overall efficiency of the engine 10.

One or more of the spokes 48 can define a fluid passage 50 in flow communication with the bearing compartment 52. The fluid passage 50 is operable to communicate fluid, such as cooling airflow or lubricant, between the bearing compartment 52 and a lubrication or fluid source or sink 54. The guide vane assembly 40 can be arranged such that one or more fluid passages 50 supply fluid to the bearing compartment 52, while one or more other fluid passages 50 scavenge fluid from the bearing compartment 52 for return of the fluid to the fluid source 54 or another portion of the engine 10. In some examples, only some of the spokes 48 define a fluid passage 50, while others do not. In one example, each of the spokes 48 defines a fluid passage 50.

Figure 5:
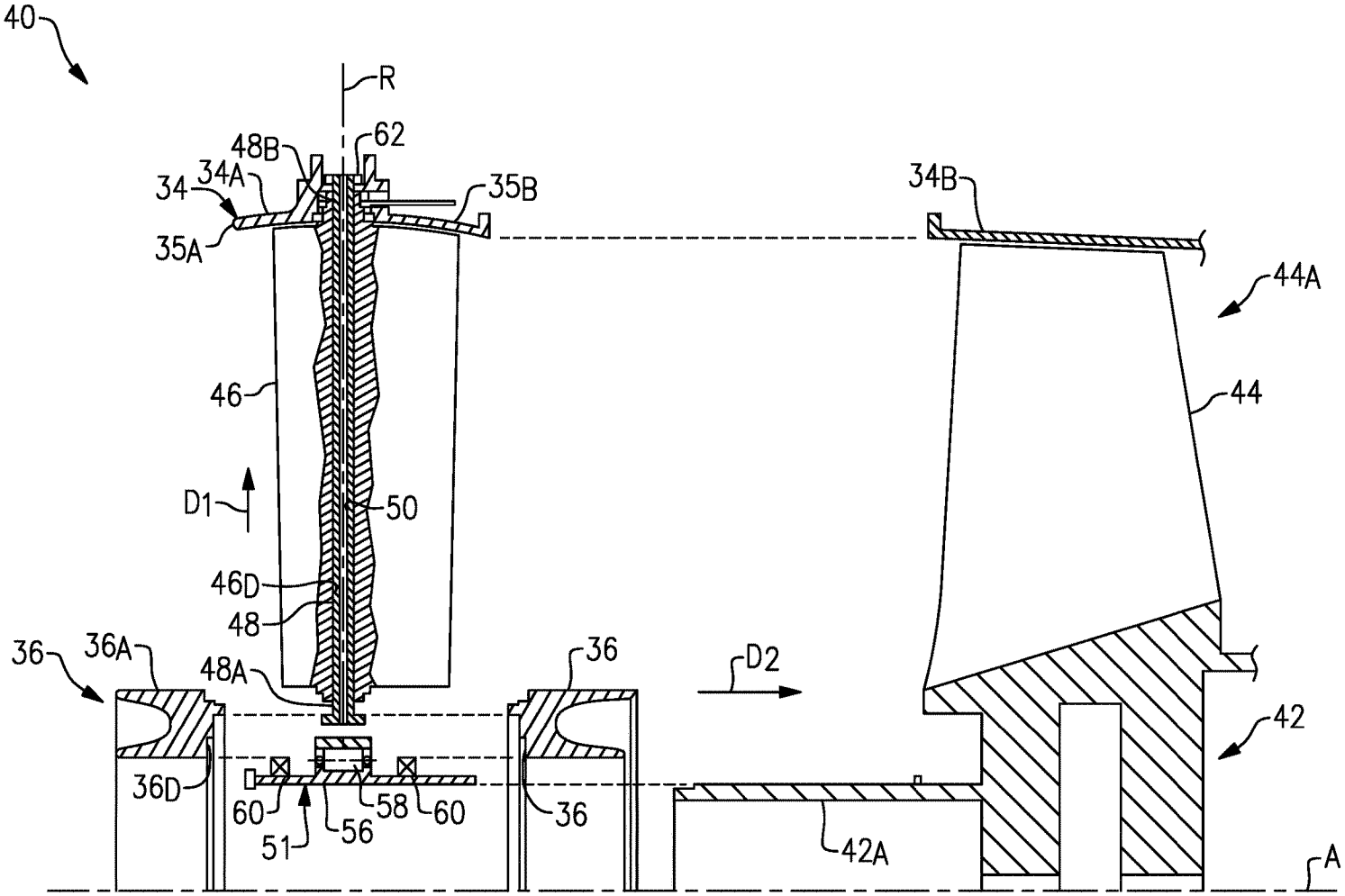
FIG. 5 illustrates an exploded view of the guide vane assembly of FIG. 3.

FIG. 5 illustrates an exploded view of the guide vane assembly 40. The guide vane assembly 40 and fan section 12 can be assembled as follows. Each guide vane 46 is attached to a respective spoke 48 by moving the spoke 48 in a direction D1 from a radially inward location to a radially outward location such that the spoke 48 is received in the bore 46D of one of the guide vanes 46. The second annular hoop 36B of the shroud 36 is moved in direction D2 along the engine axis A to at least partially surround the forward portion 42A of the rotor assembly 42.

The bearing assembly 51 is moved generally in direction D2 to abut against the forward portion 42A of the rotor assembly 42 and to abut against the second annular hoop 36B of the shroud 36. Fastener 62 can be utilized to secure the radially outward end 48B of each spoke 48 to the first section 34A of the fan case 34. The first annular hoop 36A is moved generally in direction D2 along the engine axis A to abut against the second annular hoop 36B, and to support the radially inward ends 48A of the spokes 48. A desired amount of tension can be applied to the spokes 48 via a threaded connection, for example, by providing rotational force to the fastener 62.

In the assembled position, the spokes 48 are operable to transfer loads between the forward portion 42A of the rotor assembly 42 and the fan case 34. During operation, the fluid passages 50 of spokes 48 communicate fluid between the bearing assembly 51 and the fluid source 54 (FIG. 3).

The guide vane assembly 40 can be utilized to reduce or omit bifurcations that may otherwise be utilized for providing structural support forward of the guide vane assembly 40, thereby reducing the overall axial length of the engine 10. The spokes 48 also provide support for the guide vanes 46, and can be utilized to communicate lubricant or other fluid to the bearing assembly 51. The combination of the features disclosed herein can reduce a complexity of the engine 10 and provide for a more compact engine arrangement.

Although particular step sequences are shown, described, and claimed, it should be understood that steps may be performed in any order, separated or combined unless otherwise indicated and will still benefit from the present disclosure.

It should be understood that relative positional terms such as "forward," "aft," "upper," "lower," "above," "below," and the like are with reference to the normal operational attitude of the vehicle and should not be considered otherwise limiting.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An inlet section for a gas turbine engine, comprising:

an outer case extending about a rotor that is rotatable about an engine axis, the rotor carrying a plurality of airfoils;

a plurality of guide vanes operable to guide flow from an engine inlet toward the plurality of airfoils relative to the engine axis; and a plurality of spokes mechanically attached to the outer case, each of the plurality of spokes received in a respective one of the plurality of guide vanes, and at least one of the plurality of spokes defining a fluid passage in flow communication with a bearing assembly.

2. The inlet section as recited in claim 1, wherein the section is free of any bifurcations and rotatable airfoils between the engine inlet and the plurality of guide vanes.

3. The inlet section as recited in claim 1, wherein the bearing assembly supports a forward portion of the rotor relative to the engine axis.

4. The inlet section as recited in claim 1, wherein each of the plurality of guide vanes is rotatable about a respective one of the plurality of spokes to vary flow to the plurality of airfoils.

5. The inlet section as recited in claim 1, wherein the fluid passage is operable to communicate lubricant between the bearing assembly and a lubrication source.

6. The inlet section as recited in claim 1, comprising a shroud mechanically attached to the plurality of spokes, the shroud supporting the bearing assembly.

7. The inlet section as recited in claim 6, wherein the shroud includes a first annular hoop and a second annular hoop joined together to support radially inward ends of the plurality of spokes.

8. The inlet section as recited in claim 7, wherein:

the bearing assembly includes a bearing carrier trapped between the shroud and the rotor within a bearing compartment defined by the bearing assembly, and the bearing carrier is trapped between the first annular hoop and the second annular hoop;

the fluid passage is operable to communicate lubricant between the bearing assembly and a lubrication source;

the plurality of spokes are operable to transfer loads between the rotor and the outer case;

the first annular hoop and the second annular hoop are separate and distinct components;

the first annular hoop and the second annular hoop have opposed walls that abut against each other along a radially extending interface;

each radially inward end of a respective one of the plurality of spokes defines an annular flange that abuts against walls of an adjacent recess defined by the first and second annular hoops; and the plurality of guide vanes and the plurality of spokes are separate and distinct components.

9. The inlet section as recited in claim 8, wherein each of the plurality of guide vanes is rotatable about a respective one of the plurality of spokes to vary flow to the plurality of airfoils.

10. The inlet section as recited in claim 6, wherein the plurality of spokes are operable to transfer loads between the rotor and the outer case.

11. The inlet section as recited in claim 6, comprising a bearing carrier trapped between the shroud and the rotor within a bearing compartment defined by the bearing assembly.

12. A gas turbine engine, comprising:

a section including an engine inlet and an outer case, the outer case at least partially surrounding a rotor that is rotatable about an engine axis, the rotor carrying a plurality of airfoils;

a bearing assembly supporting a forward portion of the rotor, the bearing assembly defining a bearing compartment;

a turbine driving a fan or a compressor; and a guide vane assembly, comprising:

a plurality of guide vanes operable to guide flow from the engine inlet toward a forwardmost row of the plurality of airfoils; and a plurality of spokes mechanically attached to the outer case, each of the plurality of spokes received in a respective one of the plurality of guide vanes, and at least some of the plurality of spokes defining a fluid passage in flow communication with the bearing compartment.

13. The gas turbine engine as recited in claim 12, wherein the section is dimensioned such that substantially all incoming flow through the engine inlet is delivered to the guide vane assembly.

14. The gas turbine engine as recited in claim 12, wherein the section is attached to a nacelle assembly operable to guide flow to the engine inlet and around the engine.

15. The gas turbine engine as recited in claim 12, wherein the section is free of any bifurcations and rotatable airfoils forward of the guide vane assembly.

16. The gas turbine engine as recited in claim 15, comprising a nose cone configured to guide flow between the engine inlet and the guide vane assembly.

17. The gas turbine engine as recited in claim 12, wherein the plurality of spokes are operable to transfer loads between the bearing assembly and the outer case.

18. The gas turbine engine as recited in claim 12, wherein each of the plurality of guide vanes is rotatable about a respective one of the plurality of spokes to vary flow to the plurality of airfoils.

19. The gas turbine engine as recited in claim 12, comprising a hub including a first annular hoop and a second annular hoop joined together to support radially inward ends of the plurality of spokes, with the hub defining the bearing compartment.

20. The gas turbine engine as recited in claim 19, wherein:

the plurality of guide vanes and the plurality of spokes are separate and distinct components;

the bearing assembly includes a bearing carrier that carries at least one bearing situated in the bearing compartment, the bearing carrier trapped between the first annular hoop and the second annular hoop;

the first annular hoop and the second annular hoop are separate and distinct components; and the first annular hoop and the second annular hoop have opposed walls that abut against each other along a radially extending interface.

21. A method of assembly for a section of a gas turbine engine, comprising:

providing a hub including a first annular hoop and a second annular hoop;

moving the first annular hoop along an axis to at least partially surround a rotor carrying a plurality of airfoils, with an end of the rotor supported by a bearing assembly;

attaching a plurality of spokes to an outer case that at least partially surrounds the plurality of airfoils, each of the plurality of spokes supporting a guide vane operable to guide flow from an engine inlet toward the plurality of airfoils; and moving the second annular hoop along the axis to abut the first annular hoop and support radially inward ends of the plurality of spokes, with the hub supporting the bearing assembly.

22. The method as recited in claim 21, comprising tensioning each of the plurality of spokes, with the plurality of spokes operable to transfer loads between the end of the rotor and the outer case.

23. The method as recited in claim 21, wherein one or more of the plurality of spokes defines a fluid passage operable to communicate lubricant between a bearing compartment of the bearing assembly and a lubrication source.

* * * * *